US009435126B2

(12) United States Patent
Kasinski et al.

(10) Patent No.: US 9,435,126 B2
(45) Date of Patent: Sep. 6, 2016

(54) FOLDING STAIRS, ESPECIALLY LIGHT WOODEN STAIRS

(71) Applicant: FAKRO PP Sp. z o.o, Nowy Sacz (PL)

(72) Inventors: Boguslaw Kasinski, Limanowa (PL); Bartlomiej Mos, Nawojowa (PL)

(73) Assignee: FAKRO PP SP. Z.O.O., Nowy Sacz (PL)

( * ) Notice: Subject to any disclaimer, the term of this patent is extended or adjusted under 35 U.S.C. 154(b) by 371 days.

(21) Appl. No.: 13/790,429

(22) Filed: Mar. 8, 2013

(65) Prior Publication Data

US 2013/0256057 A1 Oct. 3, 2013

(30) Foreign Application Priority Data

Mar. 9, 2012 (PL) ..... 398383

(51) Int. Cl.
*E04F 11/06* (2006.01)

(52) U.S. Cl.
CPC ..... *E04F 11/064* (2013.01); *E04F 11/06* (2013.01)

(58) Field of Classification Search
USPC ..... 182/77, 78, 81
See application file for complete search history.

(56) References Cited

U.S. PATENT DOCUMENTS 3,901,353 A * 8/1975 Skolnik ..... 182/78
2005/0029044 A1* 2/2005 Latimer et al. ..... 182/78

FOREIGN PATENT DOCUMENTS

PL 199927 B1 5/2008

* cited by examiner

*Primary Examiner* — Katherine Mitchell
*Assistant Examiner* — Shiref Mekhaeil
(74) *Attorney, Agent, or Firm* — Grossman, Tucker, Perreault & Pfleger, PLLC.

(57) ABSTRACT

There is provided folding stairs having three segments of ladder stairs connected to one another with hinges. The first segment of stairs is connected with an articulated joint to a door frame using hinge holders fitted on the inside wall of the door frame, such that, during unfolding of these stairs rotation axle of the first segment of stairs does not change its position against the door frame. A flap is suspended to the first segment of stairs with at least two pairs of connecting rods, which together with the first segment of stairs and the flap form four-bar linkage.

15 Claims, 5 Drawing Sheets

FOLDING STAIRS, ESPECIALLY LIGHT WOODEN STAIRS

FIELD OF THE INVENTION

The presently disclosed subject matter relates to folding stairs, especially light wooden stairs designed for installation in the ceiling of a building, opening downwards and unfolding into the room located under the ceiling. Folding stairs of the invention may be used in building industry, mainly used for accessing lofts.

BACKGROUND

Folding stairs having hinge mechanisms with varied rotation axis are known, as for example hinge mechanisms according to Polish patent No. 199927, providing folding stairs with closing flaps covering the door frame opening, where this flap also serves as a supporting structure for stair segments which are attached thereon. Because such flap functions as a supporting structure, the flap must be properly reinforced, so that it can sustain loads from both the weight of the stair segments and the weight of the users going up or down these stairs.

SUMMARY

Folding ladder stairs, especially light wooden stairs, designed for installation in the ceiling of a building, opening downwards and unfolding into the room located under this ceiling, are mounted onto a door frame fitted within the ceiling. The folding stairs have a set of ladder stair segments connected to one-another with hinged joints and from its bottom face to a flap for closing the door frame. The first segment of stairs is connected by an articulated joint to the door frame with hinge holders fitted onto the internal wall of the door frame. During the unfolding of the stairs, the rotation axis of the first stair segment does not change its position relative to the door frame. The flap is suspended on the first segment of the stairs with at least two pairs of connecting rods, which together with the first segment of stairs are parts of a four-bar linkage. Within the pairs of connecting rods, the one located closest to the hinge holders, at least one of the connecting rods is a double-arm lever connected in its central part rotationally to the first segment of stairs. The arm of this lever opposite to the flap is connected to a pull rod to the door frame, and advantageously to the hinge holder.

In the folded state, when all the segments of the ladder stairs are positioned within the door frame, the flap closes the door frame, whereas during the opening of the stairs into the room located under the ceiling, the flap opens downwards together with the stairs and stays opened during the unfolding of the stairs, and during their usage and folding.

Individual segments of the ladder stairs are connected to one-another with hinges located at the segment joints, on the top or on the bottom stringers of those segments. The first segment, located at the highest position when the stairs are unfolded, is connected to the second segment with high-axle hinges, possessing a rotation axle positioned on the upper surface of the stringers of this segment of stairs. The next segments of stairs, i.e. the second and third segments, are connected to one-another with low-axle hinges possessing a rotation axle positioned on the lower surface of the stringers of these segments of stairs.

The first segment of stairs is suspended from the door frame also with distance connecting rods located at both sides of this segment, on the outside of its stringers. The role of these distance connecting rods is to limit the opening angle of the first segment of stairs. Each of these two connecting rods advantageously consists of two flat pull rods, connected by a joint. The lower ends of the connecting rods are connected to a transverse supporting beam, protruding at both sides of the first segment of stairs beyond the stringers. The supporting beam is placed in recesses located in lower surfaces of the stringers of the first segment of stairs and is located in close vicinity of the middle section of this segment. The supporting beam is provided with lug connecting it to the stringers of the first segment of stairs. When the supporting beam is fitted without clearance to the width of the recesses in the stringers of the first segment of stairs, a single lug located at the outer side of the stringers is sufficient. When clearance appears between the widths of the supporting beam and the recesses in the stringer, lugs should be fitted on both sides of the supporting beam, directed both to the hinge holders connecting the first segment to the door frame and to the high-axle hinge connecting the first and second segments of stairs. In such case, stresses in stringer recess zones are transferred to the lugs of the supporting beam.

The ladder stairs are also provided with tension springs, supporting the rising of the stairs during their closing and slowing the dropping of the stairs during their opening. In the first example of the invention, these springs connect the first segment of stairs to the door frame, so that the low ends of the springs are attached to the first segment of stairs with holders fitted to the external surfaces of the stringers of this segment of stairs. In the second example of the invention, the low ends of the springs are fitted to movable components of stairs in the vicinity of the supporting beam connections with distance connecting rods. The springs can be attached either to the distance connecting rods in the vicinity of their low ends or to the supporting beam.

The upper ends of the tension springs are advantageously fitted to outriggers sticking out upward from the door frame. The springs work in direction slightly deviated from the perpendicular, thus enabling the decrease of the force component in the spring imposed by the weight of the stairs. The tension force of the springs is chosen advantageously in such a way, that the springs keep the set of ladder stairs in the closed position. Therefore, a flap need not be provided with a lock to maintain the ladder stairs in the closed position, and requires only a towing eye on which to pull down to open the stairs and the flap. Outriggers are fitted in the door frame with screws, so that they can be dismounted during storage and transport of the ladder stairs.

The folding stairs, by using the segments of stairs, instead of the flap, as supporting elements, in connecting the moving components to the door frame have a lighter flap, so they are more convenient to use and less expensive than other known ladder stairs. Placing supporting beam in recesses of the first segment of stairs, and the availability to dismount the spring outriggers during transport contribute to decrease the overall dimensions of the folded stairs, thus facilitating their storage and transport.

The folding stairs, especially light wooden stairs, being the subject matter of the present invention, are shown in examples of three-segment stairs, where the first example is shown in the drawing, the individual figures of which are:

DETAILED DESCRIPTION

Figure 1:
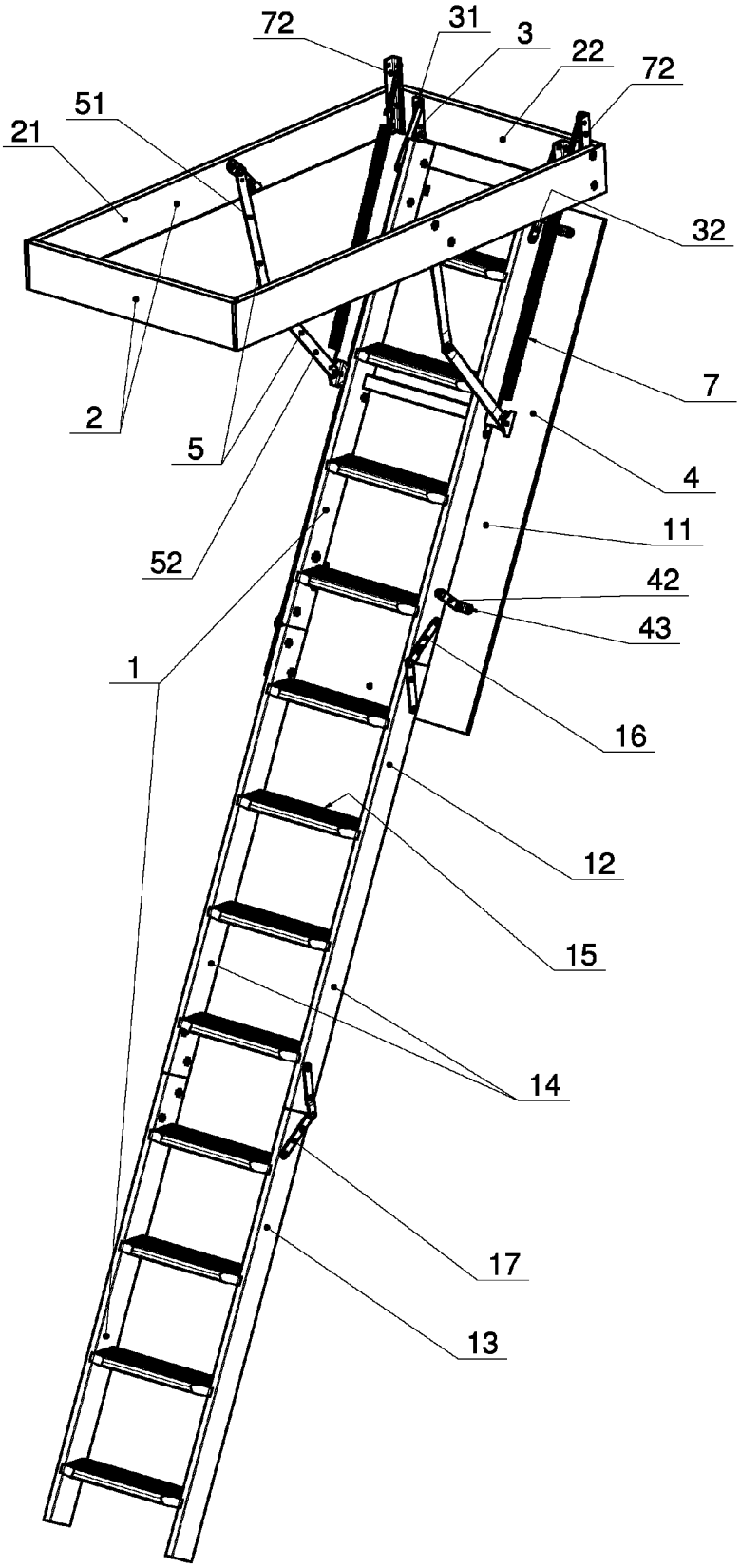
FIG. 1 is a schematic representation showing the stairs unfolded for use—in axonometric projection, according to one example of the invention.

Other examples of the invention are presented in the description by pointing out technical features distinguishing them from the first example, shown in the drawings mentioned above.

Example 1

Referring to FIG. 1, a set of segments of ladder stairs 1 is a main component of the folding stairs, including the first segment 11, the second segment 12 and the third segment 13. Each of those segments contains two stringers 14, a left one and a right one, with steps 15 fitted between them, and the individual segments are connected to each other with hinges fitted to stringers 14 at their end sections. The segments of stairs, the first 11 and second 12, are connected with high-axle hinges 16, which have their rotation axle at the upper surface of the stringers 14 of these segments; whereas the second segment 12 and third segment 13 are connected with low axle hinges 17, with their rotation axle at the lower surface of the stringers 14 of these connected segments. The stairs have also a door frame 2 in the form of a frame with two longitudinal walls 21 and two transverse walls 22. The door frame is seated in the ceiling, over the room, from which the stairs can be unfolded during use. The first segment 11 of the unfolded stairs is situated at the highest position among all three segments, the second segment 12 is at the middle and the third segment 13 of the unfolded stairs is located in the lowest position and rests against the floor of the room under the ceiling. In the folded position, the stairs segments, the second 12 and the third 13, are resting on the first segment 11, and the whole set of segments of ladder stairs 1 is placed within the door frame 2.

Figure 2:
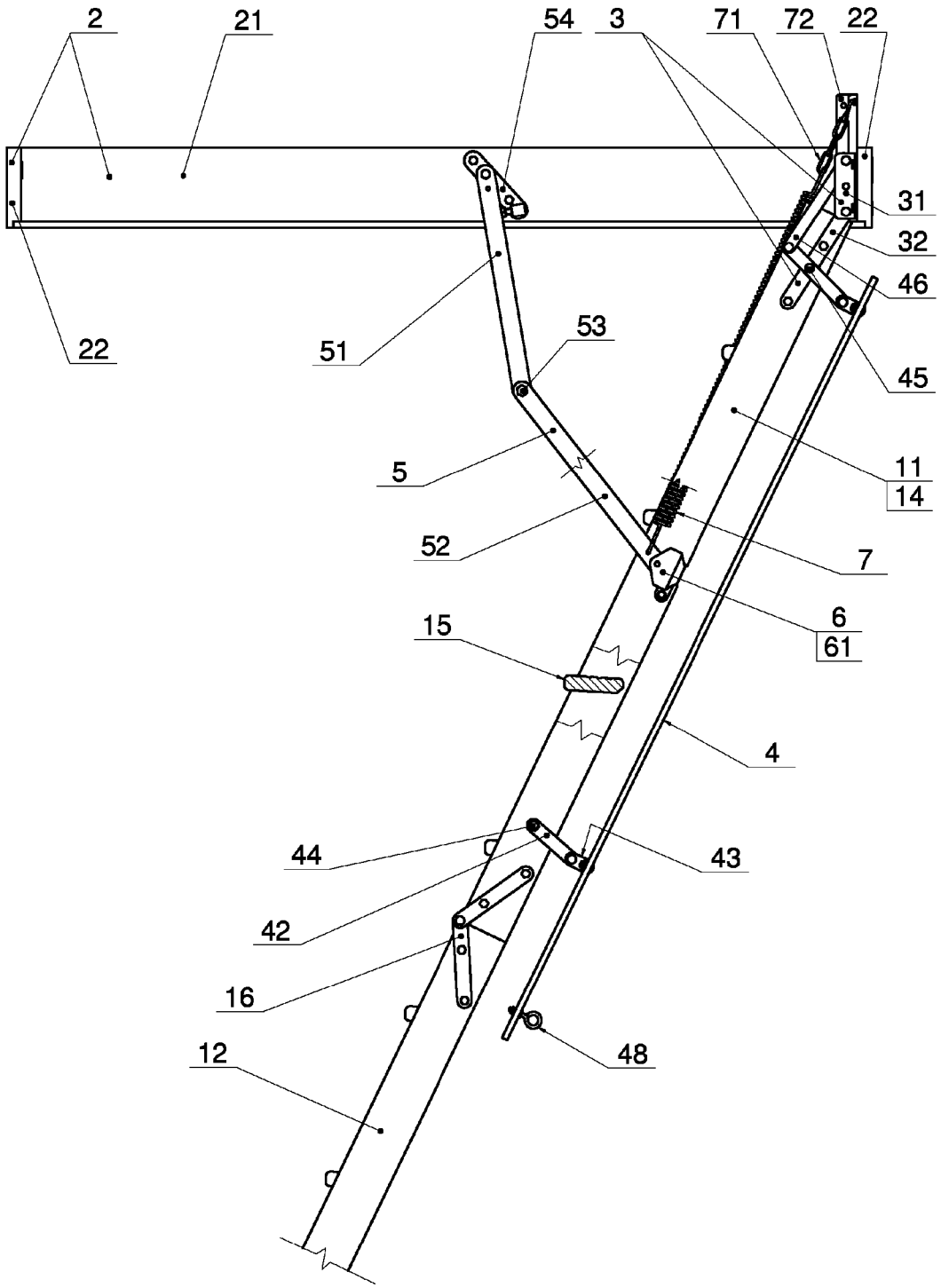
FIG. 2 is a schematic representation showing the first and second segments of stairs unfolded for use—in side view with section across the door frame, according to one example of the invention.

Referring to FIG. 2, the first segment 11 is connected by its stringers 14 to transverse wall 22 of the door frame with two hinge holders 3, and each of these holders consists of an angle section 31 and a stringer strip 32, connected by a pin located at the bottom end of the angle section 31. Both hinge holders 3 are located in such a way that their pins 33 are concentric, forming a common rotation axle against the door frame 2, for the first segment 11 and for the other two segments of stairs, whereas the rotation axle of these segments does not change during the folding or unfolding of the stairs. The angle section 31 and the stringer strip 32 are fitted with bolts 34, respectively, to transverse wall 22 of the door frame and to the stringers 14 of the first segment 11 of stairs.

Figure 3:
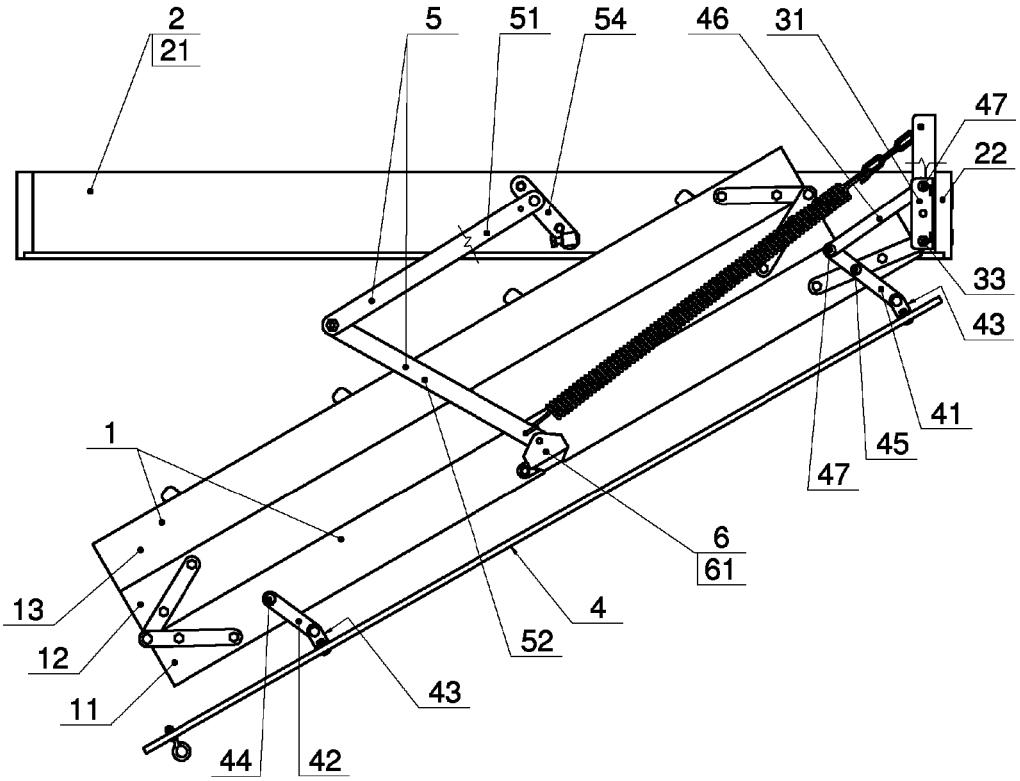
FIG. 3 is a schematic representation showing the stairs folded, in a partially open position—in side view with a cross section of the door frame, according to one example of the invention.

The stairs are also provided with a flap 4, closing the bottom opening of the door frame 2, when the set of segments of the ladder stairs 1 is folded and placed within the door frame. Flap 4 is suspended off the first segment 11 of stairs by two pairs of connecting rods, wherein the connecting rods of each pair are at both sides of the first segment 11 of stairs, outside of the stringers 14 of this segment. Referring to FIG. 3, two-arm connectors 41 are located at the hinge holders 3, and, near the opposite end of the first segment 11 of stairs; there are straight connectors 42. The low ends of connectors 41, 42 are fitted with holders 43 to the flap 4, and the upper end of the straight connector is fitted by an articulated joint with screw 44, to the first segment 11 of stairs. Two-arm connector 41 is connected in its mid-section, to stringer strip 32 with central pin 45, and the upper end of the two-arm connector 41, with the pull rod 46, is connected with angle section 31 in its upper part. At both its ends, pull rod 46 is connected by articulated joints to parts it works with. Flap 4 has on its lower surface, at the side opposite to hinge holders 3, an ear 48 for catching a hook to open the stairs.

Figure 6:
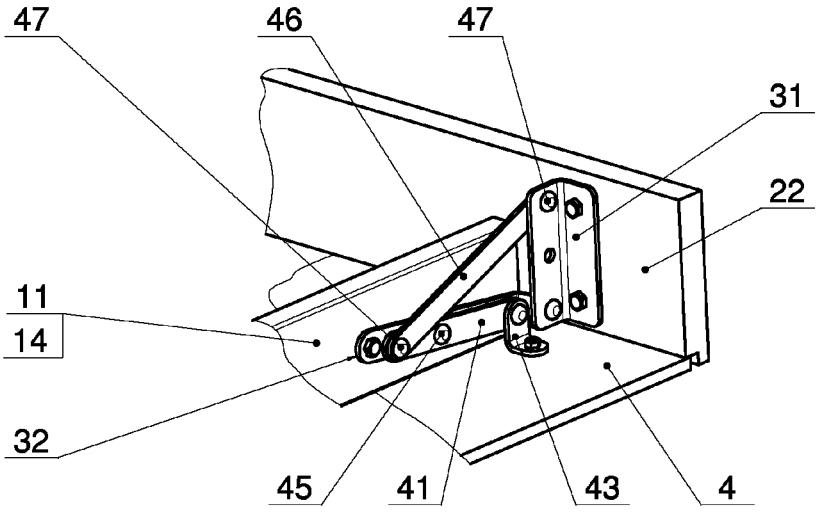
FIG. 6 is a schematic representation showing a detail of a connection from FIG. 5 of the stairs in the closed position—in axonometric projection, according to one example of the invention.

The first segment 11 of stairs, the upper part between central pin 45 and holder 46 of the two-aim connector 41, the straight connector 42 and the flap 4 create a first four-bar linkage mechanism, the motion of which is entrained by the interaction of the holder 46 and the upper part of the two-arm connector 41, the latter two also create, together with the angle section 31 and the stringer strip 32, a second four-bar linkage mechanism. While the placement of the set of ladder stairs 1 inside the door frame 2, in the last phase of the closing of the set of stairs to its resting position, the mechanisms of both four-bar linkages place flap 4 in position adjacent to door frame 2 (—see FIGS. 4 and 6). The distance between the flap 4 and the first segment 11, and also between the whole set of ladder stairs 1 in the closed position of stairs, is minimal, therefore, the whole structure is compact, which facilitates the transport and storage of the folding stairs. With the stairs in the open position, including open for use, both four-bar linkages switch the flap 4 into a position distant from the first segment 11 (—see FIGS. 1, 2 and 3), thus providing a proper clearance for the feet of a person going up or down the steps 15 of this segment, thus facilitating the use of the stairs.

Figure 7:
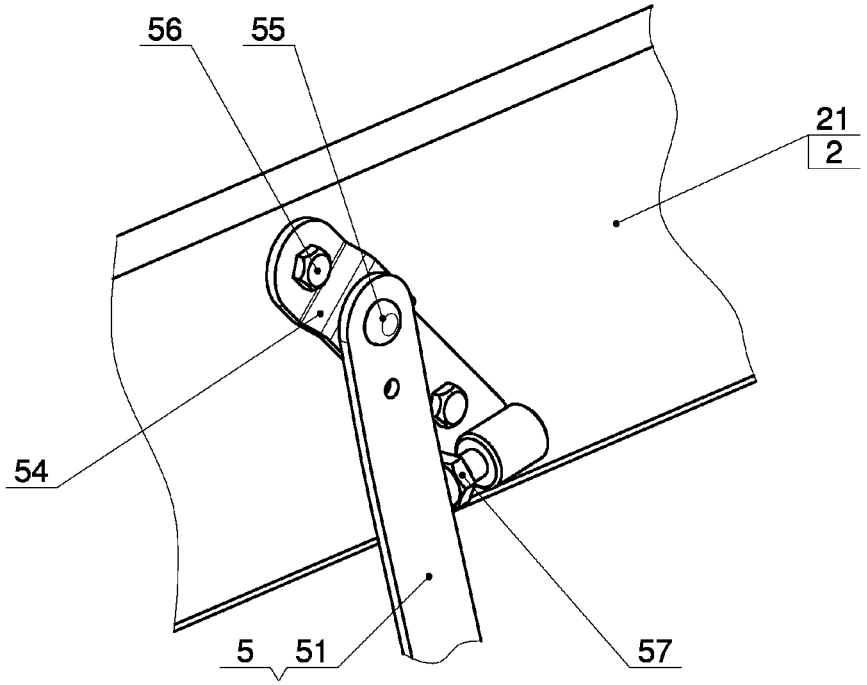
FIG. 7 is a schematic representation showing a detail of the fitting distance connecting the rod to the door frame—in axonometric projection, according to one example of the invention.
Figure 8:
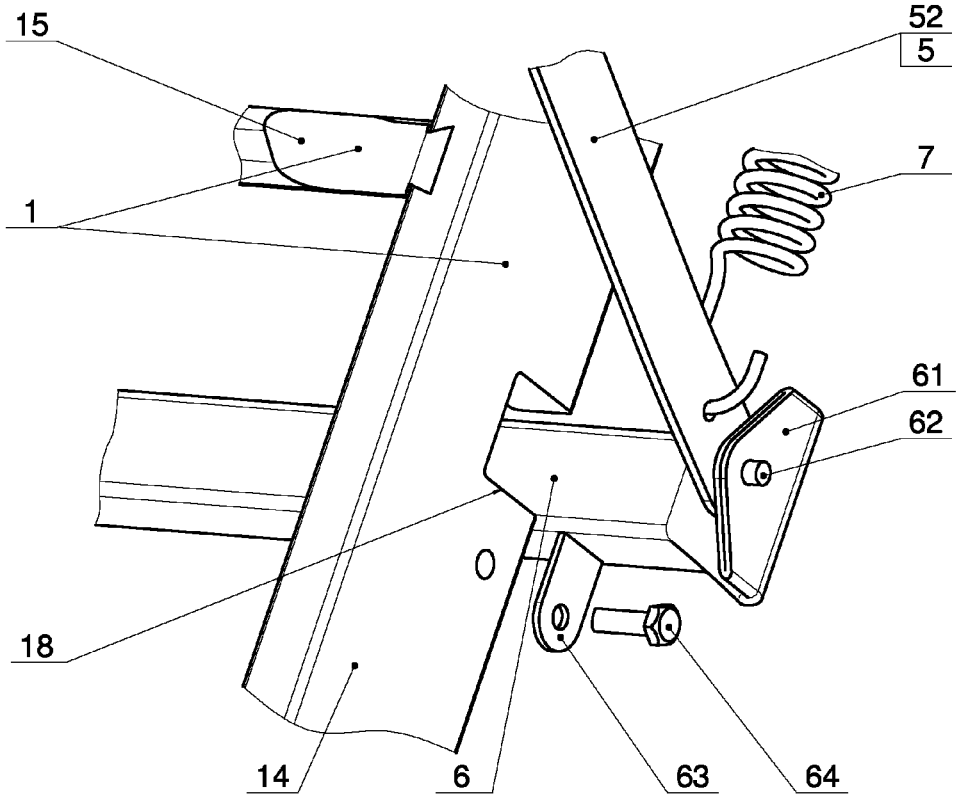
FIG. 8 is a schematic representation showing a detail of the connection of the supporting beam to the first segment of stairs and the distance pull rod—in axonometric projection, with expanded components, according to one example of the invention.

Referring to FIG. 8, the first segment 11 of stairs, apart from the connection with the door frame 2 with two hinge holders 3, is also suspended from the door frame with a pair of distance connecting rods 5, located at both sides of this segment, on the outside of its stringers 14. Each distance connecting rod consists of two flat pull rods, upper pull rod 51 and lower pull rod 52, connected at a joint 53. The ends of both lower pull rods 52 are connected to each of the supporting beam 6, which projects out at both sides of the first segment 11 of stairs beyond the stringers 14 of this segment. The supporting beam is ended with bends forming lugs 61, which are connected by pins 62 to the lower pull rods 52 of both distance connecting rods. Referring to FIG. 7, the upper end of distance connecting rod 5 is fitted in the door frame with side holder 54, which is connected to the end of the upper pull rod 51 with pin 55. Side holder 54 is fitted with bolts 56 to the longitudinal wall 21 of the door frame 2, moreover, in this holder 54 is mounted an adjusting screw 57, which limits the range of motion of the upper pull rod 51 and thus also of the whole distance connecting rod 5.

Referring to FIG. 8, the supporting beam 6, located in the vicinity of the middle section of the first segment 11 of stairs, is placed in recesses 18 positioned in the lower surfaces of the stringers 14 of the first segment. Placing the beam in these recesses allows the minimization of the distance between the flap 4 and the first segment 11 of stairs in their closed position. The supporting beam, with lugs 63, is fitted to the stringers 14 of the first segment 11 of stairs, at its right and left side, with bolts 64. Both supporting beam 6 and recesses 18 in stringer of 14 of the first segment 11 of stairs have rectangular cross-sections and are matched to one another without any clearance, which enables to fit the beam to the stringer with only one lug at each side of the segment of stairs.

Figure 4:
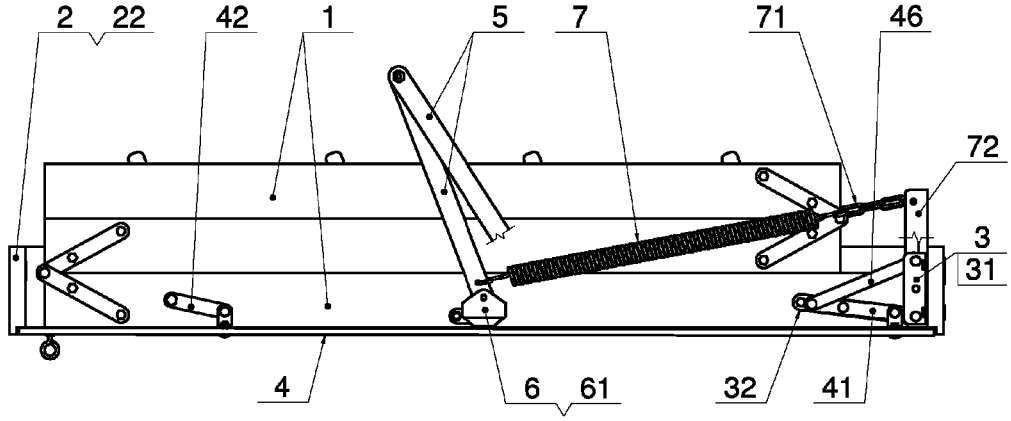
FIG. 4 is a schematic representation showing the stairs folded in a closed position—in side view with a cross section of the door frame, according to one example of the invention.
Figure 5:
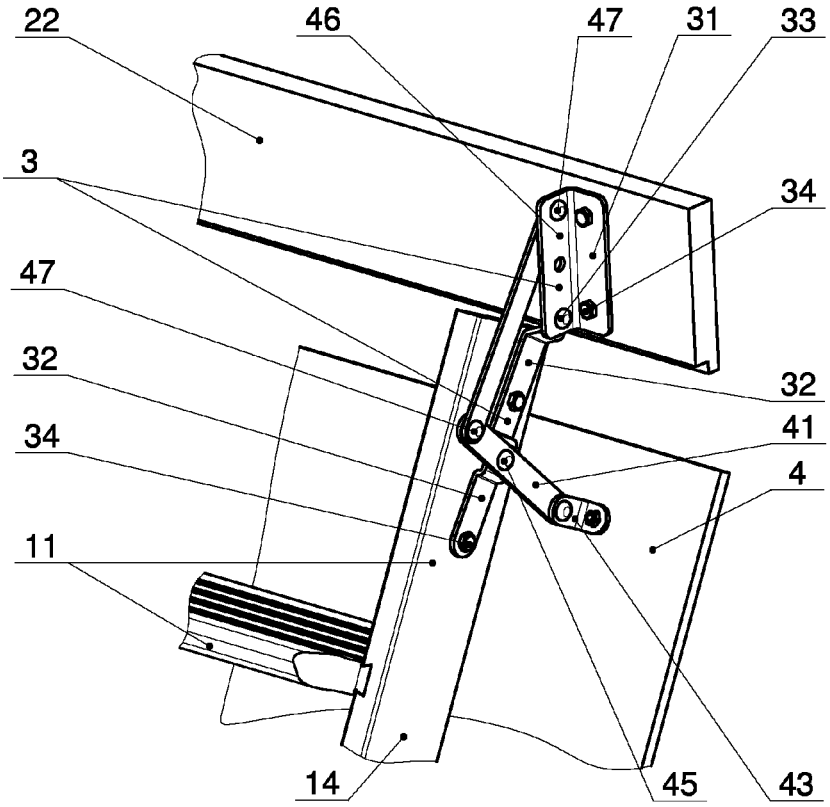
FIG. 5 is a schematic representation showing a detail of a connection of the first segment of stairs with the door frame in the unfolded position in use—in axonometric projection, according to one example of the invention.

Referring to FIGS. 3 and 4, the folding stairs are also provided with two tension springs 7, which support the rising of the stairs during their closing and slow the dropping of the stairs during their opening. The lower ends of these springs are fitted to the lower pull rods 52 of distance connecting rod 5 in the vicinity of the joint of this pull rod to the supporting beam 6. The upper ends of tension springs 7 are fitted with coil chain section 71 to outriggers 72 mounted in the corners of the door frame 2 with bolts. The outriggers protrude upwards from the door frame.

Example 2

The folding stairs of this example consist of the same set of segments of the ladder stairs as in the first example. They have the same flap closing the door frame from the bottom, the same set of four-bar linkages connecting the flap to the first segment of stairs and the same suspending of this segment in door frame using a supporting beam. However, the springs are mounted in a different way than in the first example, because their lower ends are connected to catches fitted directly to the stringers of the first segment of stairs.

Example 3

The folding stairs of this example consist of the same set of segments of ladder stairs as in the first example. They have the same flap closing the door frame from the bottom and the same set of four-bar linkages connecting the flap with the first segment of stairs. The springs are fitted in the same way to lower pull rods of distance connecting rods in vicinity of the lower ends of those pull rods. A different solution is however applied for connecting the supporting beam with the stringers of the first segment of stairs, because the supporting beam is placed with some clearance in the recesses of the lower surface of these stringers and provided with lugs directed both in the direction of the high-axle hinges (in the same way, as in first example—lugs 63, FIG. 8), and in the opposite direction, towards hinge holders connecting the first segment of stairs with the transverse beam of the door frame.

Example 4

The folding stairs of this example include a set of segments of ladder stairs, the hinge holders, the distance connecting rods, the supporting beam and the flap with the sets of four-bar linkages—the same as in the first example. The springs supporting the rising of the stairs are also fitted in the same way as in first example. The tension force of the springs is, however, chosen in a different way, being somewhat less than in the first example, so that the balance point of the stairs is in a partially open position. The flap is locked with a rotational bolt located at its side opposite to the hinge holders. The bolt works with a seat located in the transverse wall of the door frame.

What is claimed is:

1. A downwardly opening, folding stairway, for installation in a ceiling of a building, comprising:

a flap pivotably connected to a door frame via at least one hinge mechanism, the flap for closing an opening in the door frame mounted in the ceiling;

ladder stair segments, including a first ladder stair segment and at least a second ladder stair segment, each of the ladder stair segments comprising stringers pivotably coupled by high-axle hinges located at joints between said ladder stair segments; and a plurality of connecting rod assemblies pivotably coupling the flap to the first ladder stair segment, the plurality of connecting rod assemblies providing at least two four-bar linkages;

wherein each of the connecting rod assemblies includes a first member having a first and a second end and a second member having a first end and a second end, the first end of the first member pivotably coupled to the first ladder stair segment, the second end of the first member pivotably coupled to the first end of the second member, and the second end of the second member non-pivotably affixed to the flap;

wherein, when moved into a folded position, the connecting rod assemblies are configured to move the flap proximate the first ladder stair segment; and wherein, when moved into an unfolded position, the connecting rod assemblies position the flap away from the first ladder stair segment; and wherein a major longitudinal length of the first ladder stair segment remains substantially parallel to a major longitudinal length of the flap while moving between said positions.

2. The folding stairway of claim 1, further comprising:

a plurality of hinge holders coupling the first ladder stair segment to an inner side wall of the door frame, each of the hinge holders including an articulated joint;

a pair of two-arm levers positioned close to the hinge holders, wherein the pair of two-arm levers, at a middle section of each two-arm lever, is rotatably connected to the first ladder stair segment and a pull rod couples an arm of each two-arm lever opposite the flap to the door frame.

3. The folding stairway of claim 2 wherein the hinge holders are fitted on said door frame.

4. The folding stairway of claim 1, further comprising a pair of connecting rods suspending the first ladder stair segment within the door frame.

5. The folding stairway of claim 4 wherein each of said connecting rods comprises two flat pull rods, connected by a joint.

6. The folding stairway of claim 4, wherein said connecting rods are fitted to a transverse supporting beam, protruding at both sides of the first ladder stair segment beyond said stringers of the first ladder stair segment.

7. The folding stairway of claim 6 wherein said connecting rods are located at about a mid-point of the first ladder stair segment.

8. The folding stairway of claim 6, wherein said supporting beam is placed in a recess formed in lower surfaces of each stringer of the first ladder stair segment and is provided with lugs to connect said beam to the stringers of the first ladder stair segment.

9. The folding stairway of claim 8 wherein two lugs are provided on said supporting beam.

10. The folding stairway of claim 6, further comprising tension springs having lower ends connected to distance connecting rods at a location near the supporting beam and supporting the folding stairway when closing and slowing the dropping of the folding stairway when opening.

11. The folding stairway of claim 10, characterized in that an upper end of the tension spring is fitted to an outrigger protruding upwards from the door frame.

12. The folding stairway of claim 1, further comprising tension springs connecting the first ladder stair segment with the door frame, supporting the folding stairway when closing and slowing the dropping of the folding stairway when opening.

13. The folding stairway of claim 1 wherein the plurality of connecting rod assemblies provide at least two four-bar linkages movably coupling the flap to the first ladder stair segment.

14. The folding stairway of claim 1 wherein the first ladder stair segment is pivotably coupled to the second ladder stair segment with high-axle hinges having an axis of rotation at a front surface of the stringers of both the first ladder stair segment and the second ladder stair segment.

15. The folding stairway of claim 1, further comprising:

a plurality of hinge holders pivotably coupling the first ladder stair segment to the door frame;

wherein each of the hinge holders comprises an articulated joint, the hinge holders being fitted to an inner side wall of the door frame;

wherein each of the hinge holders maintain an axis of rotation of the first stair segment in a fixed position with respect to the door frame throughout the range of motion of the folding stairway.

* * * * *